United States Patent [19]

Morton, Jr.

[11] Patent Number: 4,811,475

[45] Date of Patent: Mar. 14, 1989

[54] PLANT HANGER

[75] Inventor: John C. Morton, Jr., Ocala, Fla.

[73] Assignee: Jodac, Inc., Ocala, Fla.

[21] Appl. No.: 80,994

[22] Filed: Jul. 29, 1987

[51] Int. Cl.[4] ..... B21D 39/00

[52] U.S. Cl. ..... 29/521; 29/525.1; 52/39; 248/217.3; 248/317; 248/339; 248/546

[58] Field of Search ..... 248/317, 339, 340, 343, 248/216.1, 217.3, 546; 52/39, 489; 29/526, 521

[56] References Cited

U.S. PATENT DOCUMENTS

| | | | |
|---|---|---|---|
| 1,175,802 | 3/1916 | Orcutt . | |
| 2,161,841 | 4/1937 | Adelman . | |
| 2,241,657 | 8/1939 | Dehring . | |
| 2,911,179 | 11/1959 | Hammerly | 248/339 |
| 2,913,204 | 11/1959 | Stewart . | |
| 3,282,547 | 11/1966 | Ables . | |
| 3,618,176 | 11/1971 | Barnes | 52/39 X |
| 3,730,466 | 5/1973 | Swanquist | 248/217.3 X |
| 3,952,985 | 4/1976 | Davenport | 248/317 |
| 4,000,596 | 1/1977 | Magill et al. | 52/489 X |
| 4,155,206 | 5/1979 | Player | 52/489 X |
| 4,236,688 | 12/1980 | Wilk . | |

*Primary Examiner*—Ramon S. Britts

*Assistant Examiner*—David L. Talbott

*Attorney, Agent, or Firm*—Fleit, Jacobson, Cohn & Price

[57] ABSTRACT

A vertically elongated thin, generally planar body constructed of at least reasonably stiff and shape retentive material is provided including opposite ends and opposite face sides and edges extending between the ends. The upper end portion of the body includes a plurality of integral angulated tangs struck therefrom, projecting outwardly from the face sides and inclined outwardly from the body toward the lower end of the body. The tangs include sharpened outer lower ends and the lower end of the body includes support structure from which an article to be suspended beneath a pan roof of the type including at least one pair of laterally adjacent elongated pan roof sections including adjacent longitudinal side upwardly projecting closely juxtaposed flanges may be supported. The upper end portion of the planar body may be wedged upwardly between at least the lower end portions of the flanges to a position with the sharpened lower ends of the tangs biting into the opposing faces of the flanges and the article to be suspended beneath the roof may be removably supported from the lower end of the planar body.

1 Claim, 1 Drawing Sheet

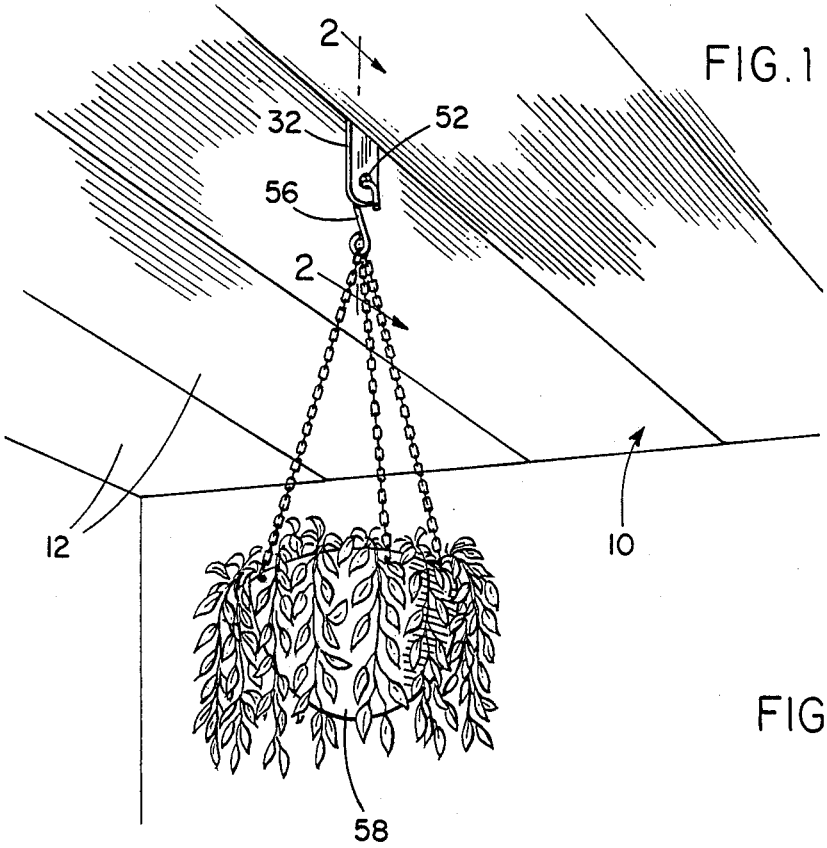
FIG. 1
FIG. 7
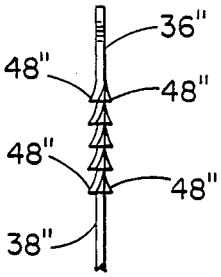
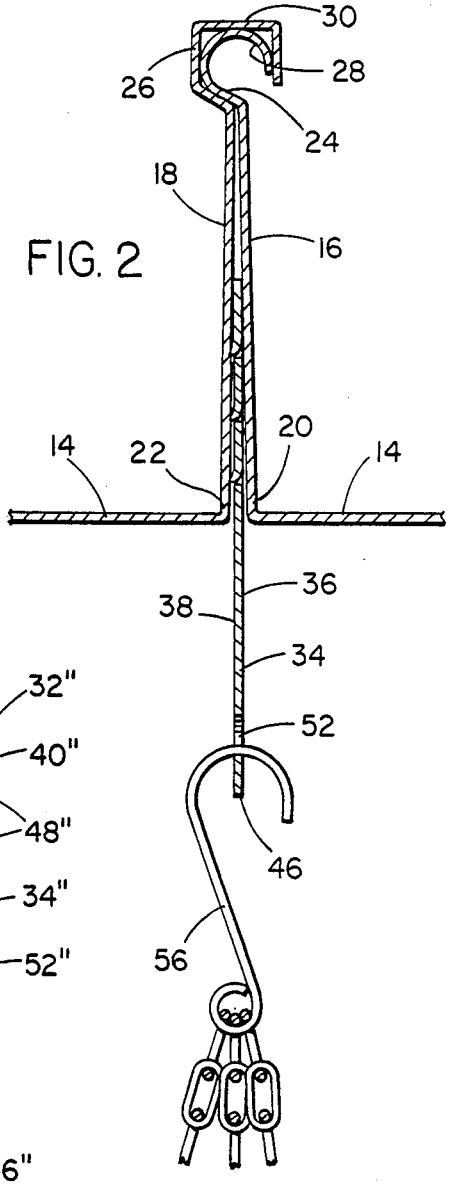
FIG. 2
FIG. 3
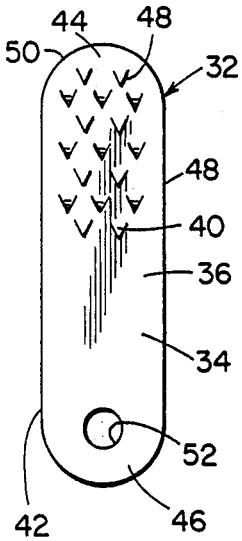
FIG. 4
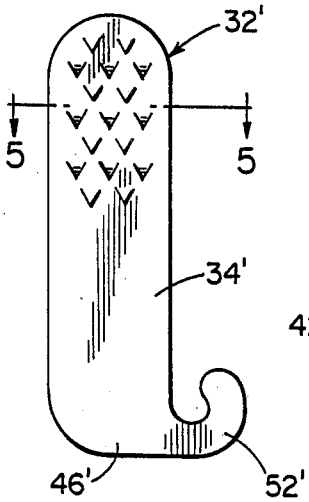
FIG. 6
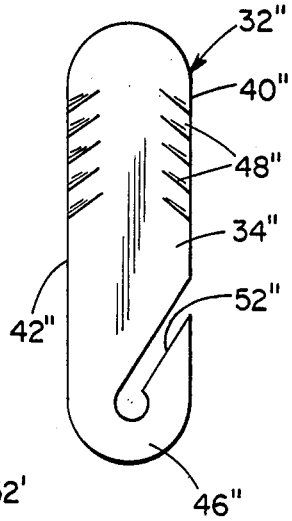
FIG. 5
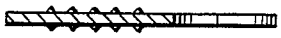

PLANT HANGER

BACKGROUND OF THE INVENTION

1. Field of the Invention

Various different forms of patio roofs and sunroom roofs projecting outward from an adjacent building structure are of lightweight construction such as the type of roof designated as an "aluminum pan roof". Such aluminum pan roofs are usually of single ply aluminum construction and articles such as potted plants, bird cages, wind chimes and light fixtures may not readily be supported beneath such roofs due to the fact that it is undesirable to secure fasteners for suspending such articles through the single ply aluminum sheets of which the roofs are constructed.

However, "aluminum pan roofs" incorporate laterally adjacent elongated roof sections with each section including a lower generally horizontal panel portion and opposite side elongated upstanding integral flanges. The flanges of adjacent panel portions are disposed in closely juxtaposed relation and the upper marginal edges thereof are secured together in a manner excluding the entrance of rain water between the flanges.

Although adjacent flanges of adjacent pan roof sections are disposed in closely juxtaposed relation, one end of an elongated thin blade-like member may be wedged upwardly between the adjacent flanges from beneath the pan roof.

While such a thin blade-like member may be wedged between adjacent vertical flanges of adjacent pan roof sections, such members may not support any appreciable weight, inasmuch as they may be readily downwardly withdrawn from between the flanges.

In order to provide a hanger for lightweight articles, an elongated upstanding blade-like member is provided having oppositely laterally struck tang portions on the upper end portion thereof projecting outwardly of opposite face sides of the blade-like member and inclined outwardly toward the lower end portion of the blade-like member. By insertion of such a tang equipped blade-like member upper end portion between adjacent flange portions of adjacent pan roof sections, the sharpened outer ends of the tangs bite into the opposing surfaces of adjacent flange portions to strongly resist downward withdrawal of the blade-like member from between the adjacent pan roof section flange portions and the lower end of the blade-like member is equipped with structure enabling one of the aforementioned articles to be suspended therefrom.

2. Description of Related Art

Various different forms of hangers, anchor brackets and support structures including some of the general structural and operational features of the instant invention are disclosed in U.S. Pat. Nos. 1,175,802, 2,161,841, 2,241,657, 2,913,204, 3,282,547 and 4,236,688. However, these previously known items are not specifically designed to be used in conjunction with an "aluminum pan roof".

SUMMARY OF THE INVENTION

The hanger of the instant invention comprises an elongated generally planar body constructed of at least reasonably stiff and shape retentive material and including opposite ends and opposite face sides and edges extending between the ends. One of the end portions of the body includes a plurality of integral angulated tangs struck from the body, projecting outwardly from the face sides of the body and inclined outwardly of the body toward the other end thereof. The tangs include sharpened outer ends and the tang equipped end of the body may be wedged upwardly between at least the lower portions of the adjacent flanges of adjacent pan roof sections whereby the sharpened ends of the tangs will bite into the opposing faces of the flanges and prevent downward withdrawal of the planar body from between the opposing pan roof section flanges to the extent that articles of considerable weight may be suspended from the lower end of the planar body which projects downwardly beneath the associated aluminum pan roof.

The main object of this invention is to provide a hanger which may be used in conjunction with an aluminum pan roof of the type hereinafter illustrated and described and wherein the hanger may be used to support articles of appreciable weight therefrom independent of any fasteners being secured through the aluminum pan roof sections.

Another object of this invention is to provide a hanger in accordance with the preceding objects and which may be constructed in various forms for use in conjunction with pan roofs which may be constructed of materials other than aluminum.

Still another object of this invention is to provide a hanger including support structures of different types whereby different articles may be suspended therefrom.

A final object of this invention to be specifically enumerated herein is to provide a hanger in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of a typical form of aluminum pan roof as seen from below and with a hanger constructed in accordance with the present invention being utilized to suspend a potted plant from beneath the roof;

FIG. 2 is an enlarged fragmentary vertical sectional view taken substantially upon the plane indicated by the section line 2—2 of FIG. 1;

FIG. 3 is an enlarged side elevational view of the hanger illustrated in FIGS. 1 and 2;

FIG. 4 is a side elevational view of a first modified form of hanger;

FIG. 5 is an enlarged fragmentary horizontal sectional view taken substantially upon the plane indicated by the section line 5—5 of FIG. 4;

FIG. 6 is a side elevational view of a second modified form of hanger; and

FIG. 7 is a fragmentary enlarged side elevational view of the hanger illustrated in FIG. 6 and as seen from the left side thereof.

DESCRIPTION OF THE PREFERRED EMBODIMENT

Referring now more specifically to the drawings, the numeral 10 generally designates a typical "aluminum pan roof" incorporating a plurality of elongated side-by-side pan roof sections 12 each including a lower generally horizontal panel portion 14 and a pair of integral, longitudinally extending and upstanding opposite side flanges 16 and 18. The flanges 16 and 18 include lower marginal portions 20 and 22 and upper marginal portions 24 and 26 and are generally planar and parallel between the upper and lower marginal portions thereof. The upper marginal portions 24 each are formed to define a downwardly opening hook 28 and the upper marginal portions 26 each are formed to define a downwardly opening channel 30 in which the adjacent downwardly opening hook is snugly seated defining a weather tight shield against the entrance of rain water between adjacent flanges 16 and 18.

The opposite ends of the sections 12 are of course adequately supported against movement relative to each other and the adjacent building structure and the sections 12 are at present constructed of aluminum which comprises a reasonably soft metal.

A first form of hanger constucted in accordance with the present invention is referred to in general by the reference numeral 32, see FIGS. 1, 2 and 3, and comprises a vertically elongated planar body 34 constructed of a material such as steel which is appreciably harder than the aluminum of which the sections 12 are constructed. The body 34 includes opposite side faces 36 and 38 and opposite longitudinal edges 40 and 42 extending between first and second ends 44 and 46 of the body 34. The upper or first end 44 of the body 34 includes triangular shaped tangs 48 laterally struck therefrom projecting outwardly from each of the side faces 36 and 38 and the tangs 48 are inclined outwardly from the opposite side faces 36 and 38 toward the second or lower end 46 of the body 34. The tangs 48 are spaced apart longitudinally and transversely of each side face 36 and 38 of the body 34 and the upper end of the body 34 is rounded as at 50. Furthermore, the lower end 46 of the body 34 includes a ⅜" diameter opening 52 formed transversely therethrough and opening outwardly through the side faces 36 and 38.

The body 34, constructed of steel, is approximately 0.024" in thickness and is therefore shape retentive and reasonably stiff. The pointed lower ends of the tangs 48 may be considered as sharpened lower ends and the hanger 32 is placed in operation by upwardly wedging the upper end 44 of the body 34 between the lower marginal portions 20 and 22 of the flanges 16 and 18 until the body 34 is positioned substantially as illustrated in FIG. 2. In this position, the entire upper end 44 of the body 34 is wedged between the lower halves of the flanges 16 and 18 and all of the pointed tangs are engaged with the opposing faces of the flanges 16 and 18 and bite thereinto. In this manner, the tangs 48 strongly resist downwardly displacement of the body 34 from between the flanges 16 and 18. Accordingly, the hanging hook 56 of a potted plant 58 may be engaged with the opening or bore 52 for support of the potted plant from the hanger 32. In addition, other articles such as wind chimes, bird cages and light fixtures may be hung from the hanger 32, if desired.

In addition to manually upwardly wedging the upper end 44 of the body 34 between the lower marginal portions 20 and 22 of the flanges 16 and 18 in order to install the hanger as shown in FIG. 2, upward pressure may be applied to the central portion of a pan roof section 12 centrally intermediate the opposite longitudinal margins thereof. Inasmuch as the sections 12 may be flexed, such upward pressure upwardly bows the center of the section 12 and reduces the horizontal dimension between the lower marginal portions 20 and 22 thereof thereby "opening up" the space between the corresponding marginal portions 20 and 22 and the opposing marginal portions 22 and 20 of the adjacent sections 12. Once this spacing has been "opened up", the upper end 44 of the body 34 may be merely upwardly displaced into the "opened up" space without any wedging action, after which the upward pressure on the center of the section 12 may be released and manual support of the hanger 32 may be released. As soon as upward pressure on the section 12 is released, the space in which the upper end 44 is received will be narrowed and the tangs 48 will engage the opposing marginal portions 20 and 22 to prevent downward withdrawal of the hanger 32.

With reference now more specifically to FIGS. 4 and 5 of the drawings, a first modified form of hanger is referred to in general by the reference 32' and comprises a substantial duplicate of the hanger 32, except that the lower end 46' of the body 34' of the hanger 32' is provided with an integral hook 52' with which the hook 56 or a similar hook may be engaged.

With attention now invited to FIG. 6, the reference numeral 32" generally designages a second modified form of hanger. The body 34" of the hanger 32" includes opposite side longitudinal edges 40" and 42" through which laterally struck tangs 48" open and the tangs 48" project outwardly from the opposite side faces 36" and 38" corresponding to the faces 36 and 38. In addition, the lower end 46" of the hanger 32" includes an upwardly and outwardly inclined slot 52" formed therein with which either a hook or an eye on an article to be suspended may be engaged.

If in the future the sections 12 are constructed of an alternate material (which alternative material might be a new generation of plastic), the hangers 32, 32' and 32" may be constructed of a material other than steel. The use of a new generation of plastic in constructing the sections 12 may enable the hangers to be constructed of a strong aluminum, as long as that aluminum or aluminum alloy is appreciably harder than the plastic of which the sections 12 may be constructed.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. The method of suspending an article beneath a pan roof of the type including at least one pair of laterally adjacent elongated pan roof sections each including a lower flexive horizontal panel portion and wherein adjacent longitudinal margins of the panel portions include integral closely juxtaposed and upwardly projecting flanges extending therealong and joined together along upper marginal edges thereof spaced appreciably above the lower marginal edges integral with said panel portions, said method including providing an elongated upstanding generally planar body constructed of at least reasonably stiff and shape retentive material and including opposite ends and opposite face sides and edges extending between said ends and wherein the upper end of the body includes a plurality of integral angulated tangs struck from said body, projecting outward from said face sides and inclined outwardly from said body toward the lower end of said body with the outer lower ends of said tangs being sharpened and further wherein the lower end of said body includes support means from which an article to be suspended from said roof may be removably supported, applying an upward force on the transverse central area of the horizontal panel portion of one of said roof sections sufficient to upwardly bow the last mentioned horizontal panel portion sufficient to reduce the horizontal spacing between the lower marginal edges of the corresponding upwardly projecting flanges an amount causing a space to open up between one of the flanges thereof and the opposing flange of the adjacent roof section of a width greater than the thickness of said upper end, including the tangs supported therefrom, upwardly inserting said upper end between the last mentioned flanges and maintaining said upper end in position therebetween while releasing the upward thrust on said horizontal panel portion of said one roof section.

* * * * *